US006962265B1

(12) United States Patent
Zhang

(10) Patent No.: US 6,962,265 B1
(45) Date of Patent: Nov. 8, 2005

(54) DRINKING VESSEL WITH DETACHABLE, DECORATIVE HANDLE

(76) Inventor: Yan Zhang, 7016 Weston Cir., Edina, MN (US) 55439

( * ) Notice: Subject to any disclaimer, the term of this patent is extended or adjusted under 35 U.S.C. 154(b) by 0 days.

(21) Appl. No.: 10/607,356

(22) Filed: Jun. 26, 2003

(51) Int. Cl.[7] ..... B65D 25/28
(52) U.S. Cl. ..... 220/759; 220/770; 220/754
(58) Field of Search ..... 220/759, 770, 220/776, 775, 754, 753

(56) References Cited

U.S. PATENT DOCUMENTS 2,422,510 A * 6/1947 Ward ..... 294/31.2
2,922,558 A * 1/1960 Harvey ..... 294/148
3,128,905 A * 4/1964 Hesslein ..... 220/760
3,347,404 A * 10/1967 McIntyre ..... 220/486
3,688,936 A * 9/1972 Killigrew, Jr. ..... 215/396
5,203,471 A * 4/1993 Widman ..... 220/755
5,988,418 A * 11/1999 Maeshima ..... 215/396
6,149,028 A * 11/2000 Yu ..... 220/741

* cited by examiner

*Primary Examiner*—Stephen Castellano
(74) *Attorney, Agent, or Firm*—Faegre & Benson LLP

(57) ABSTRACT

A drinking vessel, such as a commemorative mug, with a detachable handle is disclosed. In an illustrative embodiment of the invention, a mug includes a ceramic vessel body and a metal handle insertably attached to the vessel body. The vessel body defines two channels extending from the vessel body in directions about 30 degrees to about 150 degrees apart. The handle has two ends and includes a flexible portion biasing the two ends to maintain both of the ends inserted in their respective channels. Each channel and its respective end of the handle have matching locking teeth that form an interlocking mechanism with the locking teeth in the channel in locking engagement with the locking teeth on the handle end.

3 Claims, 5 Drawing Sheets

DRINKING VESSEL WITH DETACHABLE, DECORATIVE HANDLE

FIELD OF THE INVENTION

The invention relates generally to drinking vessels. More particularly, the invention relates to a drinking vessel with a detachable handle.

BACKGROUND OF THE INVENTION

Drinking vessels are decorated for a wide variety of purposes. Decorative and commemorative mugs, cups and glasses that occupy large portions of souvenir shops are just some of the examples of such drinking vessels. Typically, the vessel body itself is decorated. There are several known methods for decorating ceramic and glass vessel bodies. Examples include direct screening, water-slide decal transfer, heat-release decal transfer, and dye sublimation methods.

If a vessel has a handle, the handle is typically an integral part of the vessel. For example, a ceramic coffee mug typically has a ceramic handle that was a part of the same clay body as, and fired together with, the mug body. There are also examples of handles that are attached to a vessel body by other devices, such as one or more flexible metal bands or a metal sleeve over the vessel body.

Conventional methods of decorating drinking vessels typically involve permanent or irreversible modifications to the vessels and require specialized equipment and manufacturing expertise to accomplish. Given the large variety of decorative vessels that are typically needed, a manufacturer or vendor of such vessels often must keep a far larger number of vessels than is likely to be sold in a short period. In addition, decorative possibilities are limited when decorating the mug body is the only option.

Thus there is thus a need for a more flexible and economical way to supply decorative drinking vessels and for more options for decorating drinking vessel. The invention disclosed herein is aimed at providing a drinking vessel with substantially fewer drawbacks of the conventional approaches.

SUMMARY OF THE INVENTION

Generally, the invention provides a drinking vessel that can be assembled with ease by attaching a handle, which can be decorative, for example, in the form of a statuette, to a vessel body. In one embodiment, a drinking vessel comprises a vessel body and a handle insertably attached to the vessel body. The handle can be detachably inserted into to the vessel body. The handle and the vessel body can for locking engagement where the handle in inserted into the vessel. Such locking engagement can be formed by a locking mechanism including one or more locking teeth on the handle (or the vessel body) engaged in the corresponding recesses, or with the locking teeth, in the vessel body (or handle). The handle can be attached in this manner to the vessel body at one or more locations, with the handle being flexible so as to bias the handle in the inserted position and the locking mechanism in the locked configuration. The angle of handle insertion into the vessel body can be chosen to be within an optimum range, such as 30 to 150 degrees between the two ends of the handle, to ensure a combination of ease of insertion and secure attachment. The vessel body can be made of a ceramic material or glass, while the handle can be made of a non-ceramic material, such as metal or plastic.

BRIEF DESCRIPTION OF THE DRAWINGS

Other objects and advantages of the invention will become apparent upon reading the following detailed description and upon reference to the drawings in which.

Figure 1:
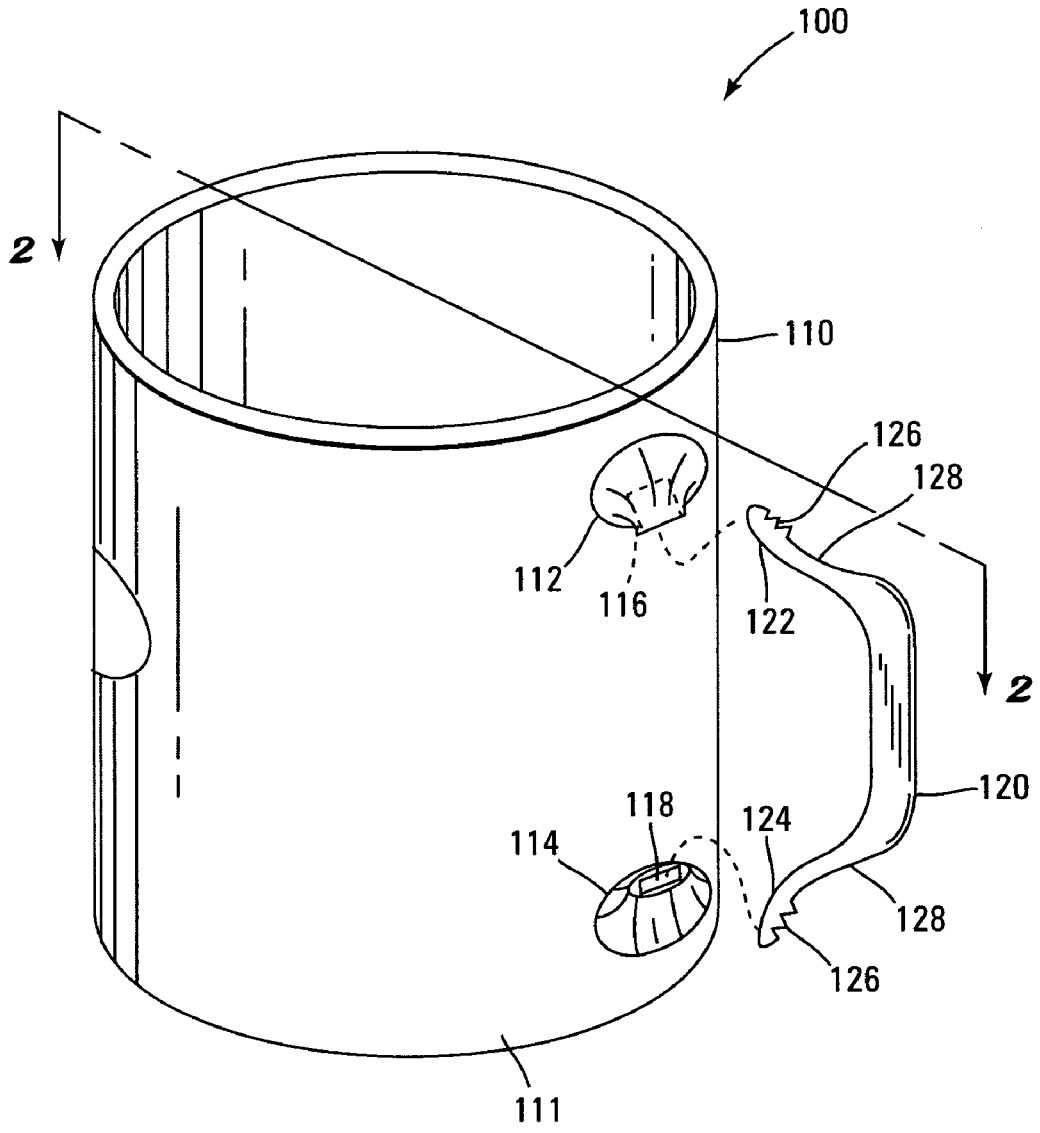
FIG. 1 schematically illustrates a disassembled view of a mug according to one aspect of the invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Referring to FIG. 1, as an embodiment of the invention, a mug 100 includes a mug body 110 and a handle 120. The mug body 110 includes on its exterior surface 111 two mounting receptacles 112, 114 for attaching the handle 120 to the mug body 110. The receptacles 112 and 114 define channels 116 (not visible) or 118, respectively, into which the two ends 122 and 126 of the handle 120 can be inserted. The mug body 110 is made of porcelain in an illustrative embodiment of the invention but can be made of any suitable material, including other types of ceramic materials, metal, plastic and glass.

Figure 2:
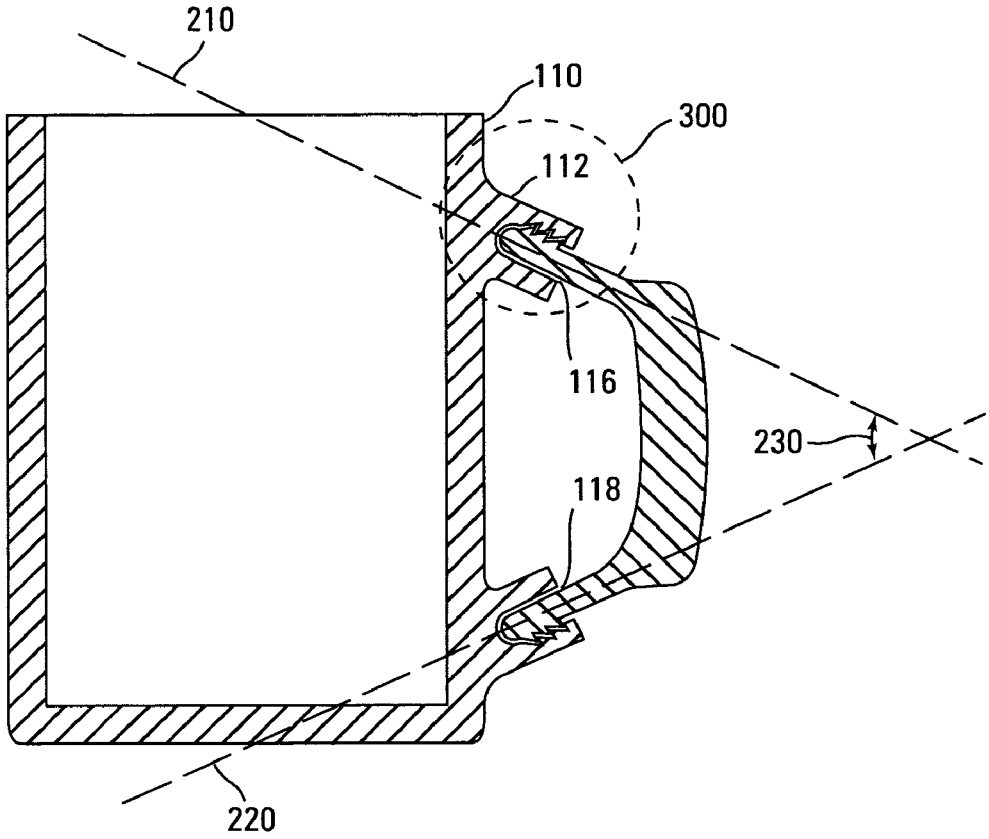
FIG. 2 shows a cross-sectional view of the mug in FIG. 1, with the handle attached to the mug body.
Figure 3:
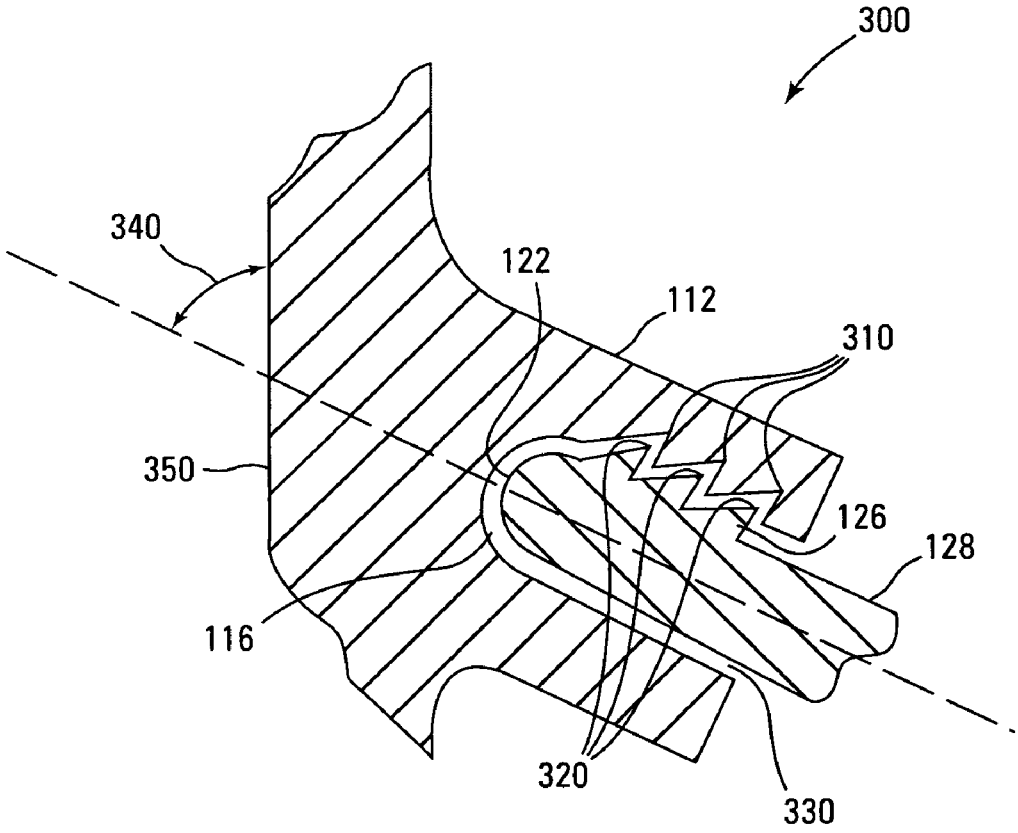
FIG. 3 shows a more detailed view of one of the locking mechanisms between the handle and the body of the mug shown in FIG. 2.

Referring also to FIG. 2, the channels 116 and 118 extend in directions apart from each other by an angle 230, which can be any size suited for a particular mug configuration. For example, the angle 230 can be between about 30 degrees and about 150 degrees. With further reference to FIG. 3, each channel 166 or 118 forms an angle 340 with the wall 350 of the mug body 110. The angle 340 is about 45 degrees for both top and bottom channels in one embodiment, but can be other suitable sizes. For example, the angle 340 can be from 30 to 60 degrees or 15 to 75 degrees.

The handle 120 is made of stainless steel in an illustrative embodiment of the invention but can be made of any suitable material, including other metals, plastics and ceramic materials. In the illustrative embodiment, when the handle is detached from the mug body 110 and is in a relaxed state, the distance between the two ends 122 and 124 of the handle 120 is larger than the distance between the tips of the mounting receptacles 112 and 114. The handle 120 includes two flexible portions 128 so that the handle can be elastically bent to position the two ends 122 and 124 for insertion into the channels 116 and 118, respectively. Once the ends 122 and 124 are inserted, the flexible portions 128 bias the ends to maintain them inside the channels.

It should be noted that for the inserting-type handle mounting described above and illustrated in FIGS. 1–3, it is advantageous, though not necessary, to have the channels 116 and 118 disposed at an angle that is not substantially perpendicular or parallel to the vessel wall 350. In the former case, it become more difficult to maintain the end of the handle inserted in the channel; in the latter, it become more difficult to bend the handle sufficiently to insert the ends. An intermediate angle, such as 30 to 60 degrees, or about 45 degrees, between the channel, or the end portion of the handle, and the vessel wall provides a reasonable combination of secure handle position and ease of insertion.

The ends 122 and 124 are in a locking engagement with the vessel body 110 via the locking mechanisms 300 once the ends 122 and 124 are inserted into the channels 116 and 118, respectively. Each end portion 122 or 124 has one or more locking teeth 126 that are engaged in the corresponding notches, or recesses, 310 inside the channel 116 or 118. Of course, the locking mechanism 300 can also be viewed as comprising two set of locking teeth, those 126 on the end portion of handle 120 and those 320 in the channel. The flexible portion 128 of the handle 120 maintains the locking engagement between the end portion 122 or 124 and the vessel body 120.

Each channel 116 or 118 defines a space that includes a sufficiently large gap 330 between the end portion 122 or 124 and the channel wall so that the locking teeth 126 on the end portion 122 or 124 can be removed from the recesses 310 by flexing the handle 120, thereby removing the handle 120 from the vessel body 110.

Figure 4:
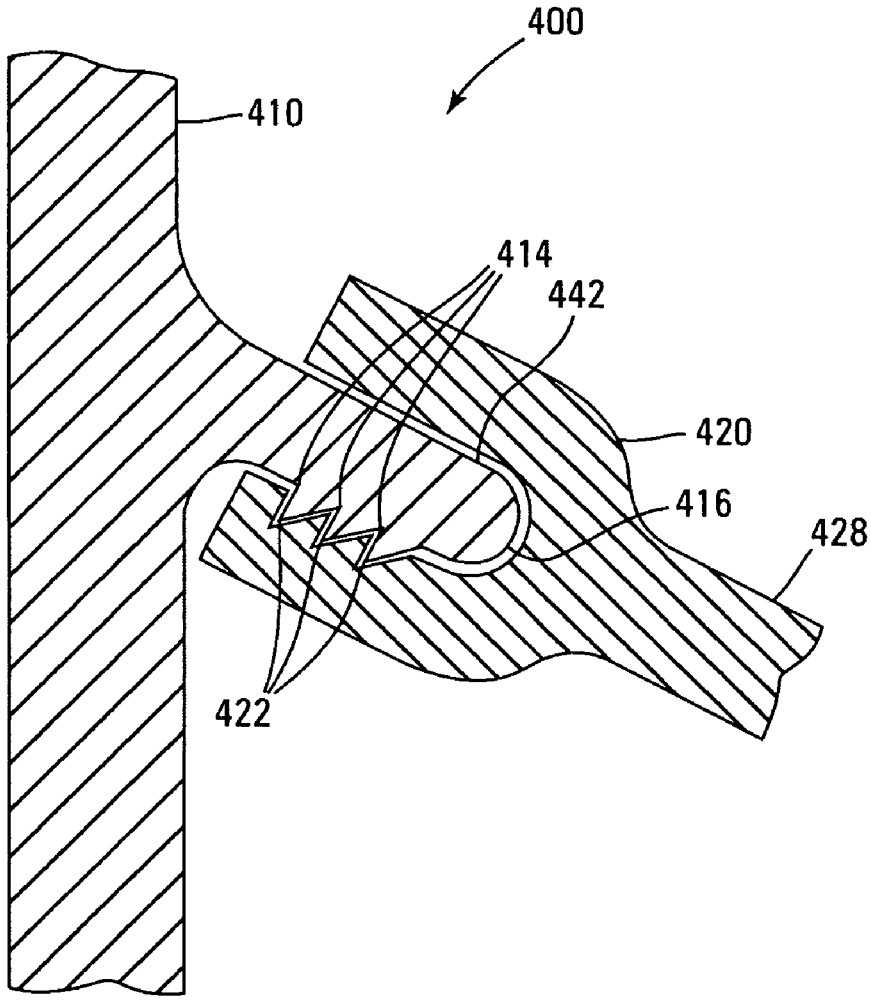
FIG. 4 shows an alternative locking mechanism in another embodiment of the invention.

Referring to FIG. 4, in another embodiment of the invention, a similar locking mechanism 400 is used. Here, a locking arm 412 protrudes from the wall of a vessel body 410. A handle 420 is coupled to the vessel body by inserting the locking arm 421 into an end channel 416 of the handle 420. The locking arm has one or more locking teeth 414 that are received by the recesses 422 in the channel 416 to put the vessel body 410 in a locking engagement with the handle 420. A flexible portion 428 of the handle biases the handle 420 to maintain the locking engagement.

Figure 5:
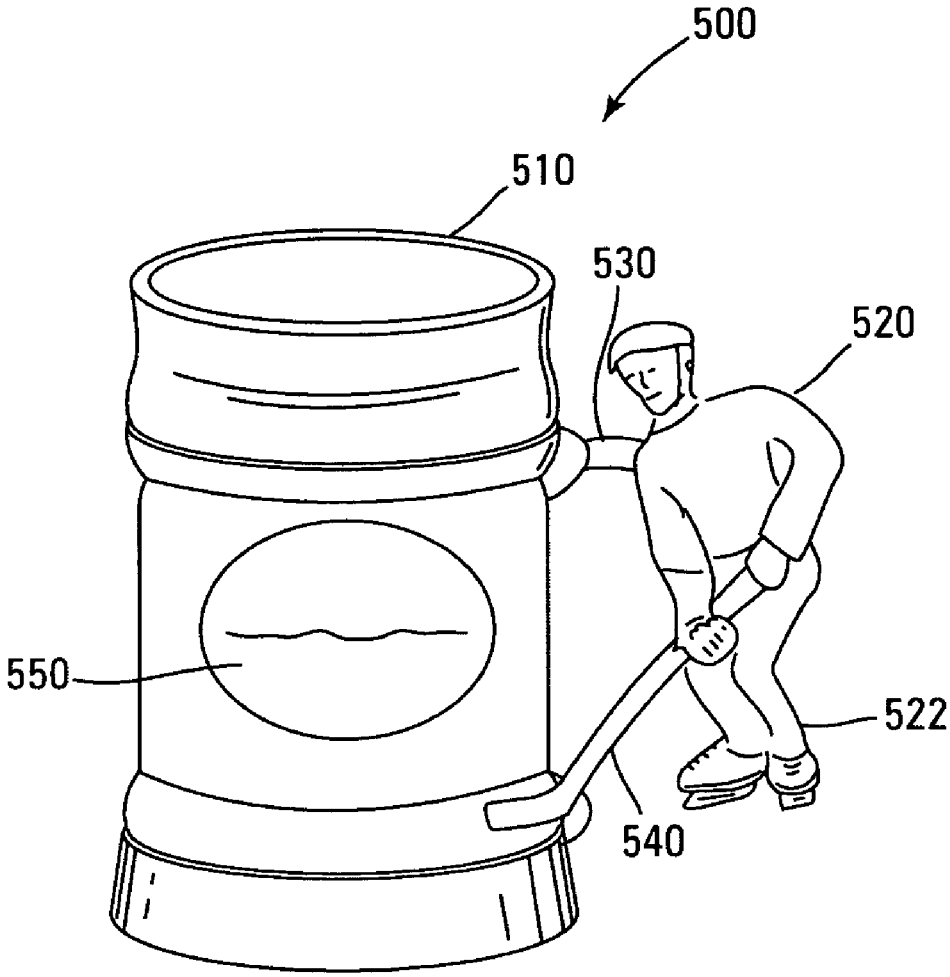
FIG. 5 shows a mug according to another aspect of the invention.

A drinking vessel according to the invention can thus be assembled by insertably attaching a handle to a vessel body. Such simple operation can be performed easily by a decorator or vendor in the field, such as in a souvenir shop, or even by a retail customer at his/her own convenience. Only a single, or relatively few, types of vessel bodies need to be made or stocked to be combined with a variety of decorative or other kinds of handles. For example, as shown in FIG. 5, to assemble an official team stein 500, a handle 520 can be made in the form of a statuette 522 (in this case of a hockey player) and attached to a stein body 510 by inserting the ends 530 and 540 into respective channels (not shown in detail) on the stein body 510. In this example, the stein body 510 also includes a patch for attaching an emblem, if desired, which further decorates the stein 500.

The invention offers, among other things, more options for creating decorative drinking vessels. A variety of decorative, detachable handle, can be made and attached to vessel bodies according the desired effects. For example, in addition to statuettes of sports figures, other types of statuettes can be used. Other possibilities include replicas of buildings, landmarks, animals, plants and manmade objects.

The invention thus provides more decorative options, ease of assembly and flexibility and economy for the decorative drinking vessel market.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A drinking vessel, comprising:

a vessel body; and a handle detachably attached to the vessel body, wherein the vessel body and the handle form first and second attachment regions spaced apart substantially in a direction of a longitudinal axis of the vessel body, the first attachment region comprising a first portion of the vessel body and a first portion of the handle, wherein one of the first portions defines a first channel, and the other of the first portions includes a first elongated portion inserted into the first channel and in locking engagement with the vessel body, wherein the first channel has an inner surface defining locking teeth, and the first elongated portion at a first end of the handle has an outer surface defining first locking teeth, wherein the locking teeth in the first channel interlock with the locking teeth of the first elongated portion when it is inserted into the first channel, a first recess defined in the first channel, the first recess capable of engaging with one or more teeth, wherein the second attachment region comprises a second portion of the vessel body and a second portion of the handle, wherein one of the second portions defines a second channel, and the other of the second portions includes a second elongated portion inserted into the second channel and in locking engagement with the vessel body, wherein the second elongated portion includes a second locking tooth, and the second portion of the vessel body defines a second recess in the second channel, the second recess being adapted to receive the second locking tooth of the second elongated portion, and wherein the handle includes a flexible portion biasing the first and second elongated portions to maintain the first and second locking teeth of the first elongated portion engaged in the first and second recesses, respectively and the locking tooth of the second elongated nation in the second recess.

2. The drinking vessel of claim 1, wherein the vessel body includes a ceramic body.

3. The drinking vessel of claim 2, wherein the first and second elongated portions of the handle extend in directions from 30 degrees to 150 degrees apart when the first and second locking teeth are engaged in the first and second recesses, respectively.

* * * * *

UNITED STATES PATENT AND TRADEMARK OFFICE

CERTIFICATE OF CORRECTION

PATENT NO. : 6,962,265 B1
DATED : November 8, 2005
INVENTOR(S) : Yan Zhang

It is certified that error appears in the above-identified patent and that said Letters Patent is hereby corrected as shown below:

Column 4,
Line 49, delete "of the first elongated portion".
Lines 51 and 52, delete "and the locking tooth of the second elongated nation in the second recess".

Signed and Sealed this

Fourteenth Day of February, 2006

JON W. DUDAS
*Director of the United States Patent and Trademark Office*